US006030735A

United States Patent [19]

Springett

[11] Patent Number: 6,030,735

[45] Date of Patent: Feb. 29, 2000

[54] PHOTOCONDUCTIVE IMAGING MEMBERS WITH POLYMETALLOSILOXANE LAYERS

[75] Inventor: Brian E. Springett, Rochester, N.Y.

[73] Assignee: Xerox Corporation, Stamford, Conn.

[21] Appl. No.: 09/414,936

[22] Filed: Oct. 12, 1999

[51] Int. Cl.[7] ..... G03G 5/047; G03G 5/14

[52] U.S. Cl. ..... 430/58.8; 430/58.65; 430/59.4; 430/59.5; 430/64

[58] Field of Search ..... 430/58.65, 58.8, 430/64

[56] References Cited

U.S. PATENT DOCUMENTS

| | | | |
|---|---|---|---|
| 3,121,006 | 2/1964 | Middleton et al. | 430/31 |
| 4,265,990 | 5/1981 | Stolka et al. | 430/96 |
| 4,298,697 | 11/1981 | Baczek et al. | 521/27 |
| 4,338,390 | 7/1982 | Lu | 430/106 |
| 4,464,450 | 8/1984 | Teuscher | 430/60 |
| 4,555,463 | 11/1985 | Hor et al. | 430/76 |
| 4,560,635 | 12/1985 | Hoffend et al. | 430/106.6 |
| 4,587,189 | 5/1986 | Hor et al. | 430/78 |
| 4,921,769 | 5/1990 | Yuh et al. | 430/64 |
| 4,921,773 | 5/1990 | Melnyk et al. | 430/132 |
| 5,871,877 | 2/1999 | Ong et al. | 430/64 |
| 5,874,193 | 2/1999 | Liu et al. | 430/64 |

OTHER PUBLICATIONS

"Polymetallosiloxane Coatings Derived from Two–step, Acid Base Catalyzed Sol Precursors for Corrosion Protection of Aluminum Substrates", by T. Sugama, J.R. Fair and A.P. Reed, *Journal of Coatings Technology*, vol. 65, No. 826, 1993, pp. 17 to 36.

*Primary Examiner*—Roland Martin
*Attorney, Agent, or Firm*—E. O. Palazzo

[57] ABSTRACT

A photoconductive imaging member comprised of a supporting substrate, a hole blocking layer thereover, a photogenerating layer and a charge transport layer, and wherein the hole blocking layer is comprised of a polymetallosiloxane.

29 Claims, No Drawings

PHOTOCONDUCTIVE IMAGING MEMBERS WITH POLYMETALLOSILOXANE LAYERS

RELATED PATENTS

In U.S. Pat. No. 5,871,877, the disclosure of which is totally incorporated herein by reference, there is illustrated a photoconductive imaging member comprised of a supporting substrate, a hole blocking layer thereover, a photogenerating layer and a charge transport layer, and wherein the hole blocking layer is comprised of a crosslinked polymer of the formula illustrated, reference column 7, beginning at line 1.

In U.S. Pat. No. 5,874,193, the disclosure of which is totally incorporated herein by reference, there is disclosed a photoconductive imaging member comprised of a supporting substrate, a hole blocking layer thereover, a photogenerating layer and a charge transport layer, and wherein the hole blocking layer is comprised of a crosslinked siloxane polymer of the formula, reference the Abstract of the '193 patent.

The appropriate components of the above recited patents may be selected for the present invention in embodiments thereof.

BACKGROUND OF THE INVENTION

This invention is generally directed to imaging members comprised of a number of functional layers, one of which is a charge blocking layer, and more specifically, the present invention is directed to multi-layered imaging members with a hole blocking layer preferably situated in between a supporting substrate and a photoelectrically active layer, or photogenerator layer, and which blocking layer is comprised of a polymetallosiloxane, especially acid hydrolyzed sol-gel polymetallosiloxanes, wherein the metal is, for example, a transition metal or multivalent metals, examples of which are titanium, zirconium, aluminum, tin, germanium, lanthanum, zinc, boron, and the like. Examples of specific polymetallosiloxane materials that may be selected as the hole blocking layer are illustrated in "Polymetallosiloxane Coatings Derived from Two-step, Acid Base Catalyzed Sol Precursors for Corrosion Protection of Aluminum Substrates", by T. Sugama, J. R. Fair and A. P. Reed, *Journal of Coatings Technology*, Volume 65, No. 826, 1993, pages 17 to 36, the disclosure of which is totally incorporated herein by reference.

The primary function of the hole blocking layer is to prevent or minimize dark injection of positive charge, such as holes from the supporting substrate into the photogenerating layer, thereby eliminating or minimizing high dark decay and/or problems associated with localized areas of discharge, that is charge deficient spots. Moreover, even in the presence of the current flows occurring during normal photoreceptor operation, the blocking layers of the present invention provide uniform corrosion resistance and anodisation resistance, or minimization to substrates such as aluminum and nickel or other readily oxidized metals. Protection against damage from acidic species present in coating solvents is also provided in embodiments of the present invention.

The imaging members of the present invention in embodiments exhibit excellent electrical properties, cyclic and environmental stability, and substantially no adverse changes in performance over extended time periods. Processes of imaging, especially electrophotographic imaging and printing, including by digital means, are also encompassed by the present invention. More specifically, the invention layered photoconductive imaging members can be selected for a number of different known imaging and printing processes including, for example, both black and white and color electrophotographic imaging processes, especially xerographic imaging and printing processes wherein negatively charged images are rendered visible with toner compositions of an appropriate charge polarity. Moreover, the imaging members of this invention are useful in color xerographic applications where several color printings can be achieved in a single pass, and in processes were the color imaging is achieved by multiple passes of the imaging members past the exposure system, and in processes where a single imaging member is devoted to each primary color. The imaging members as indicated herein are in embodiments sensitive in the wavelength region of, for example, from about 400 to about 900 nanometers, and in particular, from about 600 to about 850 nanometers, thus diode lasers or LED image bars can be selected as the light sources.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

The use of certain perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport components can be selected for the imaging members of the present invention.

In U.S. Pat. No. 4,921,769, the disclosure of which is totally incorporated herein by reference, there is illustrated photoconductive imaging members with blocking layers of certain polyurethanes. Since the polyurethanes possess a certain degree of solubility in many organic solvents, their use as the charge blocking layers may limit the choice of solvents for the next layer coated thereover, such as the adhesive layer or the photogenerator layer, during the fabrication of photoresponsive devices. Advantages of the hole blocking layer of the present invention over that of the '769 patent, especially where the blocking layer is comprised of a crosslinked polymer composition containing a covalently bonded electron transporting moiety illustrated herein, include excellent resistance to solvent degradation, superior electron transport, and excellent electrical properties, and cyclic and environmental stability.

SUMMARY OF THE INVENTION

It is a feature of the present invention to provide imaging members thereof with many of the advantages illustrated herein.

Another feature of the present invention relates to the provision of improved layered photoresponsive imaging members which are photosensitive in the red and near infrared radiation region, and more specifically, in the light wavelength range of from about 600 to about 850 nanometers.

It is yet another feature of the present invention to provide improved layered photoresponsive imaging members with a sensitivity to visible light, and which members possess improved electrical properties and enhanced cyclic/environmental stability.

Moreover, another feature of the present invention relates to the provision of layered photoresponsive imaging members with solvent resistant and durable hole blocking layers of acid hydrolyzed sol gel compositions prepared as illustrated in the *Journal of Coatings Technology*, Volume 65, No. 826, November 1993, pages 17 to 36, the disclosure of which is totally incorporated herein by reference.

Aspects of the present invention relate to a photoconductive imaging member comprised of a supporting substrate, a hole blocking layer thereover, a photogenerating layer and a charge transport layer, and wherein the hole blocking layer is comprised of a polymetallosiloxane; a photoconductive imaging member wherein the polymetallosiloxane is of the formula

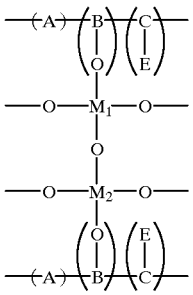

wherein A, B, and C each represent a repeating monomer segment, each represent a polymer, each represent repeating units of the polymer backbone containing appropriate linkages, such as divalent linkages; $M_1$, $M_2$ are a trivalent or tetravalent metal; and when $M_1$ or $M_2$ is a tetravalent metal, the bond structure in the sol-gel network is

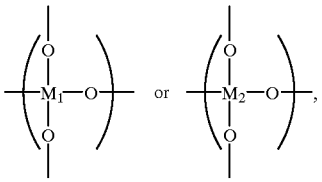

and when $M_1$ or $M_2$ is a trivalent metal the bond structure in the sol-gel network is

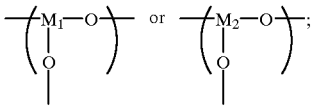

and E is an electron transport component; a photoconductive imaging member wherein the polymetallosiloxane possesses a $M_w$ of from about 50,000 to about 100,000; a photoconductive imaging member wherein the polymetallosiloxane possesses a number average molecular weight $M_n$ of from about 2,000 to about 50,000; a photoconductive imaging member wherein the metal for the polymetallosiloxane is titanium; a photoconductive imaging member wherein the metal for the polymetallosiloxane is zirconium; a photoconductive imaging member wherein the metal for the polymetallosiloxane is boron; a photoconductive imaging member wherein the metal for the polymetallosiloxane is aluminum; a photoconductive imaging member wherein the metal for the polymetallosiloxane is tin; a photoconductive imaging member wherein the metal for the polymetallosiloxane is germanium; a photoconductive imaging member wherein the metal for the polymetallosiloxane is lanthanum; a photoconductive imaging member wherein the thickness of the hole blocking layer ranges from about 0.1 to about 3 microns; a photoconductive imaging member wherein the supporting substrate is comprised of a metal; a photoconductive imaging member wherein the conductive substrate is aluminum; a photoconductive imaging member wherein the photogenerator layer is of a thickness of from about 0.05 to about 5 microns; a photoconductive imaging member wherein the transport layer is of a thickness of from about 10 to about 50 microns; a photoconductive imaging member wherein the photogenerating layer is comprised of a photogenerating pigment or photogenerating pigments dispersed in a resinous binder, and which pigments are present in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer is comprised of an arylamine dispersed in a resinous binder; a photoconductive imaging member wherein the arylamine is represented by the following formula

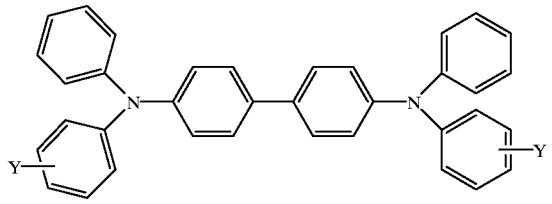

wherein Y is selected from the group consisting of alkyl and halogen atoms;

a photoconductive imaging member wherein the alkyl contains from about 1 to about 25 carbon atoms; or wherein alkyl contains from about 1 to about 5 carbon atoms; a photoconductive imaging member wherein the arylamine is N,N'-diphenyl-N,N-bis(3-methyl phenyl)-1,1'-biphenyl-4,4'-diamine; a photoconductive imaging member further including an adhesive layer preferably situated between the supporting substrate and the photogenerating layer situated thereover; a photoconductive imaging member wherein the photogenerating layer is comprised of metal phthalocyanines, perylenes or metal free phthalocyanines; a photoconductive imaging member wherein titanyl phthalocyanine, perylene, or hydroxygallium phthalocyanine is selected as the photogenerating pigment; a photoconductive imaging member wherein the photogenerating layer is comprised of Type V hydroxygallium phthalocyanine dispersed in a polymer binder; a photoconductive imaging member further containing a protective overcoat polymer layer; a method of imaging which comprises generating an electrostatic latent image on the photoconductive imaging member illustrated herein, developing the latent image, and transferring the developed electrostatic image to a suitable substrate; a photoconductive imaging member containing a hole blocking layer of the formula

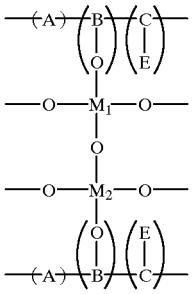

wherein A, B, and C each represent segments as illustrated herein, such as structural units of the polymer backbone containing appropriate divalent linkages, each A, B and C being repeating segments; $M_1$ $M_2$ are a trivalent or tetravalent metal; and when $M_1$ or $M_2$ is a tetravalent metal, the bond structure in the sol-gel network is

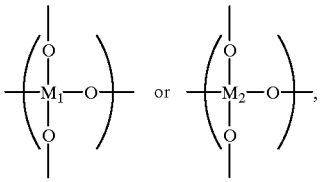

and when $M_1$ or $M_2$ is a trivalent metal the bond structure in the sol-gel network is

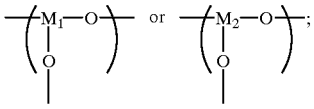

and E is an electron transport component; a photoconductive imaging member wherein A, B, and C are $A_x$, $B_y$, and $C_z$, and wherein x, y, and z are mole fractions of the repeating monomer, and wherein the sum of x, y and z are equal to about 1; and a photoconductive imaging member wherein A, B, and C are $A_x$, $B_y$, and $C_z$, and wherein the sum of x, y and z are equal to about 1.

The hole blocking layer is preferably comprised of a polymetallosiloxane as represented by the following formula

I.

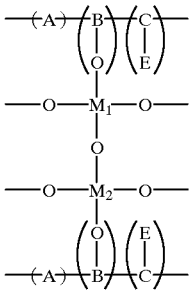

wherein $M_1$ is independently selected from the group consisting of Si, Ti, Zr, La, Al, Sn, Ge and the like; O is an oxygen atom; $M_2$ is tetravalent atom, such as Si, Ti, a trivalent atom such as aluminum; and when $M_1$ or $M_2$ is a tetravalent metal, the bond structure in the sol-gel network is

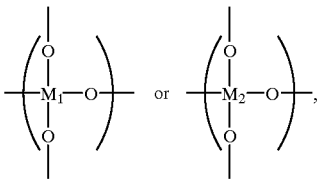

and when $M_1$ or $M_2$ is a trivalent metal the bond structure in the sol-gel network is

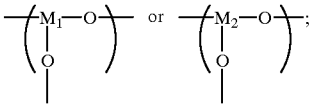

A, B, and C represent the segments of the polymer backbone containing appropriate divalent linkages, reference U.S. Pat. No. 5,871,877, the disclosure of which is totally incorporated herein by reference, E is an electron transporting moiety, reference for example the formulas of U.S. Pat. Nos. 5,871,877 and 5,874,193, the disclosures of which are totally incorporated herein by reference, and wherein the segments A, B, and C can repeat, and wherein A, B, and C can total about 1 to about 100; a photoconductive imaging member wherein x is from about 0 to about 0.95, y is from about 0.01 to about 0.50, and z is from about 0.01 to about 0.50; a photoconductive imaging member wherein the divalent linkages are independently selected from the group consisting of arylene (—Ar—), alkylenearyl (—R'—Ar—), alkyleneoxycarbonyl (—R'—O—CO—), aryleneoxycarbonyl (—Ar—O—CO—), alkylenearyloxycarbonyl (—R'—Ar—O—CO—), arylenealkoxycarbonyl (—Ar—R'—O—CO—), and carbonyloxyalkyleneaminocarbonyl (—CO—O—R'—NR"—CO—), and wherein Ar contains from about 6 to about 24 carbon atoms, R' contains from about 1 to about 10 carbon atoms, and R" is hydrogen or alkyl.

Illustrative examples of the divalent linkages include arylene (—Ar—), alkylenearyl (—R'—Ar—), alkyleneoxycarbonyl (—R'—O—CO—), aryleneoxycarbonyl (—Ar—O—CO—), alkylenearyloxycarbonyl (—R'—Ar—O—CO—), arylenealkoxycarbonyl (—Ar—R'—O—CO—), carbonyloxyalkyleneaminocarbonyl (—CO—O—R'—NR"—CO—), and the like, and wherein Ar preferably contains from about 6 to about 24 carbon atoms, R' preferably contains from about 1 to about 10 carbon atoms, and R" is hydrogen atom or alkyl group containing from about 1 to about 5 carbon atoms.

When M is a tetravalent atom, the bond structure in the sol-gel network is

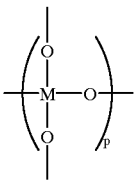

and when M is a trivalent atom, the bond structure in the sol-gel network is

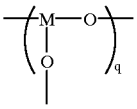

wherein each p and q represent the number of segments, which number can be, for example, from 1 to about 1,000.

There can be covalently bonded to the Formula I components

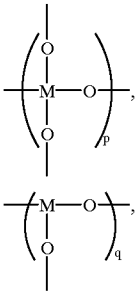

H, or a metal substrate such as aluminum, nickle and zirconium.

Embodiments of the present invention relate to a photoconductive imaging member comprised of a supporting substrate, a hole blocking layer thereover, a photogenerating layer, a charge transport layer, and optionally, a protective overcoat layer, and wherein the hole blocking layer is comprised of a polymetallosiloxane polymer illustrated herein; a photoconductive imaging member wherein the metal in the polymetallosiloxane polymer is Ti, Zr, B, Al, Sn, Ge, La, multi-valent metals or mixtures thereof, and wherein the thickness of the hole blocking layer is, for example, from about 0.5 to about 3 microns; wherein $M_n$ number average molecular weight of the hole blocking layer polymer is from about 2,000 to about 50,000 and preferably from about 2,000 to about 5,000, and comprised of a supporting substrate, a hole blocking layer thereover, a photogenerating layer and a charge transport layer, a photoconductive imaging member wherein the thickness of the hole blocking layer ranges from about 0.01 to about 5 microns; a photoconductive imaging member wherein the supporting substrate is comprised of a metal; a photoconductive imaging member wherein the conductive substrate is aluminum, aluminized MYLAR®, or titanized MYLAR®; a photoconductive imaging member wherein the photogenerator layer is of a thickness of from about 0.05 to about 5 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer is comprised of an arylamine dispersed in a resinous binder such as polystyrene, polyester or polycarbonate; a photoconductive imaging member wherein the hole transport arylamine is represented by the following formula

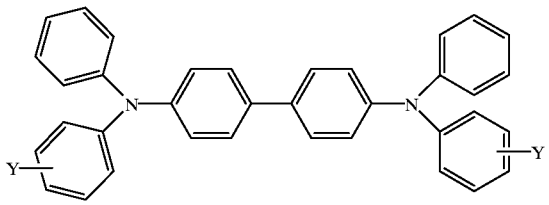

wherein Y is selected from the group consisting of alkyl and halogen atoms; a photoconductive imaging member wherein alkyl contains from about 1 to about 25 carbon atoms; a photoconductive imaging member wherein alkyl contains from 1 to about 5 carbon atoms; a photoconductive imaging member wherein the arylamine is N,N'-diphenyl-N,N-bis(3-methyl phenyl)-1,1'-biphenyl-4,4'-diamine; a photoconductive imaging member further including an adhesive layer; a photoconductive imaging wherein the photogenerating layer is comprised of metal phthalocyanines, perylenes or metal free phthalocyanines; a photoconductive imaging member wherein titanyl phthalocyanine, perylenes, or hydroxygallium phthalocyanine is selected as the photogenerating pigment; a photoconductive imaging member wherein the photogenerating layer is comprised of Type V hydroxygallium phthalocyanine dispersed in a polymer binder; and a method of printing or imaging which comprises generating an electrostatic latent image on the imaging member, developing the latent image, and transferring the image to a suitable substrate.

In embodiments the imaging members of the present invention exhibit excellent electrical properties, such as low dark decay, fast discharge, and low residual potential, and excellent cyclic and environmental stability, such as for example over 50,000 cycles in various environmental conditions of high, such as about 80 percent, and low, such as about 25 percent, relative humidity at a temperature range of, for example, from about 10° C. to about 50° C.

Examples of specific polymetallosiloxane hole blocking layers are polyaluminosiloxane, polyzincsiloxane, polystannosiloxane, polytitanosiloxane, polyzirconosiloxane, polyborosiloxane, polylanthanosiloxane, polygermanosiloxane, polyaluminosiloxane, polynickelsiloxane, and polygalliosiloxane.

The hole blocking layer can be prepared by applying a solution of the polymetallosiloxane polymer with, for example, an $M_n$ of about 2,000 to about 50,000, or preferably an $M_n$ of from about 5,000 to about 40,000 onto a supporting substrate to form a blocking layer after drying and curing, or heating at a temperature ranging from about 50° C. to about 200° C., and preferably from about 80° C. to about 150° C. for a duration of, for example, about 30 minutes to about 2 hours, and wherein the hole blocking layer has a thickness ranging from, for example, about 0.01 to about 10 microns and preferably from about 0.05 to about 5 microns. For more rapid curing of the hole blocking polymer layer, a curing catalyst, such as amine or acid, can be added to accelerate the crosslinking reactions.

Also, the hole blocking layer may be formed by coating a solution of the polymetallosiloxane sol-gel in a suitable solvent on a substrate, followed by curing at an elevated temperature ranging from about 80° C. to about 200° C. to form a mechanically strong, crosslinked hole blocking layer with a thickness ranging from, for example, about 0.5 to about 10 microns, and preferably from about 0.5 to about 3 microns. Subsequently, a charge generator layer and charge, especially a hole transport layer is formed on top of or thereover the blocking layer to provide the photoresponsive imaging members of the present invention. An optional protective overcoat may be coated on top of the charge transport layer. The fabrication of the hole blocking layer of the present invention can be accomplished by many known coating techniques such as spray, dip or wire-bar draw down methods. The coating for the blocking layers can comprise, for example, from about 3 weight percent to about 20 weight percent of the polymer in a suitable solvent. Illustrative examples of solvents that can be selected for use as the coating solvent include water and alcohols such as methyl, ethyl or propyl alcohol and preferably water and methyl alcohol in the proportion of 9:1.

The hole blocking layer may be cured and which curing or crosslinking can be accomplished at, for example, about 40° C. to about 200° C., and preferably from about 80° C. to about 150° C. for about 30 minutes to about 2 hours. The crosslinking processes can involve the hydrolysis of the alkoxysilyl groups to alkoxymetallo groups, followed by subsequent condensation to form the metallosiloxane (M—O—Si) bonds. Water that is present in the coating solvents may often be sufficient to induce the required hydrolysis reaction, or hydrochloric acid [HCl] may be added.

The hole blocking layer illustrated herein and prepared, for example, in accordance with the processes specified can be applied to the imaging members disclosed herein. Specifically, a photoresponsive imaging member of the present invention comprised of a supporting substrate, such as aluminum, an optional layer thereover of a thickness of from about 0.01 micron to 150 microns of, for example, a copper iodide, or a carbon black dispersed in a suitable binder, such as poly(vinyl fluoride), polyester, and the like; a hole blocking layer in contact with the optional layer or the supporting substrate, and which blocking layer is comprised of a polymetallosiloxane polymer and wherein the hole blocking layer is of a thickness of from about 0.5 micron to about 10 microns, and preferably about 0.5 to about 3 microns; an optional adhesive layer thereover on the hole blocking layer of a thickness of, for example, from about 0.001 micron to 0.5 micron, a photogenerator layer in contact with the adhesive layer and of a thickness of about 0.1 micron to about 2 microns; and a charge transport layer thereover of a thickness of from about 5 microns to about 50 microns comprised, for example, of an amine hole transporting compound, such as N,N'-diphenyl-N,N'-bis(3-methylphenyl)-1,1-biphenyl-4,4'-diamine, dispersed in a polymer binder.

In another embodiment, the photoresponsive imaging member of the present invention is comprised of a polymeric supporting substrate, such as a MYLAR®, coated thereover a conductive layer of, for example, aluminum or titanium; a polymetallosiloxane hole blocking layer invention as illustrated herein; an optionally adhesive layer; a charge photogenerating layer comprised of, for example, a hydroxygallium phthalocyanine Type V dispersed in about 50 weight percent in a suitable binder system of, for example, polystyrene/polyvinylpyridine; and a charge transporting layer comprised of a diamine hole transport compound, such as N,N'-diphenyl-N,N'-bis(3-methylphenyl)-1,1-biphenyl-4,4'-diamine, in a polymer binder of, for example, a polycarbonate.

Examples of the substrate layer selected for the imaging members of the present invention, which substrate can be opaque or substantially transparent, may comprise any suitable materials having the requisite mechanical properties. Thus, the substrate may be comprised of an insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In an embodiment, the thickness of this layer is from about 75 microns to about 300 microns.

The photogenerating layer can contain known photogenerating components, such as pigments like metal phthalocyanines, metal free phthalocyanines, hydroxygallium phthalocyanines, perylenes, titanyl phthalocyanines, and the like, and more specifically vanadyl phthalocyanines, Type V hydroxygallium phthalocyanine, and inorganic materials such as selenium, especially trigonal selenium. The photogenerating pigment can be dispersed in a resin binder, or alternatively no resin binder is present. Generally, the thickness of the photogenerator layer depends on a number of factors, including the thickness of the other layers and the amount of photogenerator material contained in the photogenerating layer. Accordingly, the photogenerating layer can be of a thickness of, for example, from about 0.01 micron to about 10 microns, and more specifically, from about 0.25 micron to about 1 micron when, for example, the photogenerator material is present in an amount of from about 10 to about 100 percent by weight. The photogenerating layer binder resin, present in various suitable amounts, for example from about 0 to about 90 weight percent, and more specifically, from about 1 to about 50 weight percent, may be selected from a number of known polymers such as poly(vinyl butyral), poly(vinyl carbazole), polystyrene-b-polyvinylpyridine, polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is, for example, from about 0.01 to about 30 microns and preferably from about 0.1 to about 10 microns after being dried at, for example, about 40° C. to about 150° C. for about 30 to about 90 minutes.

Illustrative examples of polymeric binder materials that can be selected for the photogenerator layers are as indicated herein, and include those polymers as disclosed in U.S. Pat. No. 3,121,006, the disclosure of which is totally incorporated herein by reference.

As an optional adhesive layer usually in contact with the hole blocking layer, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain in effective amounts, for example of from about 1 to about 20 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the charge transporting layer, which generally is of a thickness of from about 5 microns to about 75 microns, and preferably of a thickness of from about 10 microns to about 40 microns, include various suitable amines, such as amine molecules of the following formula

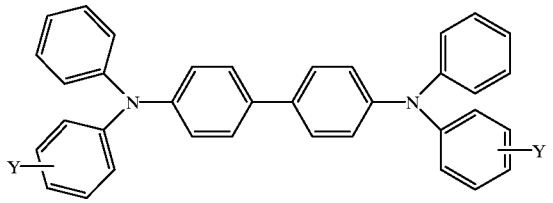

preferably dispersed in a highly insulating and transparent polymer binder, wherein Y is, for example, an alkyl group, an alkoxy group, a halogen atom, or mixtures thereof, and especially those substituents selected from the group consisting of chlorine atom and methyl group. Other known charge transporting components can also be selected.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halogen substituents are preferably chlorine substituents. Other known charge transport layer molecules can be selected, reference for example U.S. Pat. Nos. 4,921,773 and 4,464,450, the disclosures of which are totally incorporated herein by reference, and the like.

Examples of the highly insulating and transparent polymer binder material for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 30 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated.

EXAMPLE I

Synthesis of Blocking Layer Sol-Gel Polytitanosiloxane

Into a water-methyl alcohol mixture is stirred N-[3-(triethoxysilyl)propyl[-4-5-dihydroimidazole and titanium ethoxide. The proportions of the constituents of the final sol-gel in weight percent given are 78 percent of water, 8.2 percent of alcohol, 8.3 percent of imidazole, and 5.5 percent of titanium ethoxide. Hydrolysis and condensation are achieved by the sequential addition of HCl at 3.3 weight percent and NaOH at 0.5 weight percent to 96.2 weight percent of the sol-gel solution such that a pH of between 7 and 8 is achieved. Dip coating, curing and drying at 100° C. or greater yield the blocking layer polymer.

EXAMPLE II

Synthesis of Blocking Layer Sol-Gel Polyzirconosiloxane

Into a water-methyl alcohol mixture is stirred N-[3-(triethoxysilyl)propyl[-4-5-dihydroimidazole and zirconium propoxide. The proportions of the constituents of the final sol-gel in weight percent are, respectively, 78 percent, 8.2 percent, 8.3 percent, and 5.5 percent. Hydrolysis and condensation are achieved by the sequential addition of HCl at 6.6 weight percent and NaOH at 1.8 weight percent to 91.6 weight percent of the sol-gel solution such that a pH of between 7 and 8 is achieved. Dip coating, curing and drying at 100° C. or greater yield the above blocking layer component.

EXAMPLE III

Synthesis of Blocking Layer Sol-Gel Polylanthanosiloxane

Into a water-methyl alcohol mixture is stirred N-[3-(triethoxysilyl)propyl[-4-5-dihydroimidazole and lathanum isopropoxide. The proportions of the constituents of the final sol-gel in weight percent in the order given are, respectively, 78 percent, 8.2 percent, 8.3 percent, and 5.5 percent. Hydrolysis and condensation are achieved by the sequential addition of HCl at 10.8 weight percent and NaOH at 2.1 weight percent to 87.1 weight percent of the sol-gel solution such that a pH of between 7 and 8 is achieved. Dip coating, curing and drying at 100° C. or greater provide the above blocking layer polymer.

EXAMPLE IV

Synthesis of Blocking Layer Sol-Gel Polytinsiloxane

Into a water-methyl alcohol mixture is stirred N-[3-(triethoxysilyl)propyl[-4-5-dihydroimidazole and tin methoxide. The proportions of the constituents of the final sol-gel in weight percent in the order given are, respectively, 78 percent, 8.2 percent, 8.3 percent, and 5.5 percent. Hydrolysis and condensation are achieved by the sequential addition of HCl at 8.8 weight percent of the and NaOH at 2.8 weight percent to 88.4 weight percent of the sol-gel solution such that a pH of between 7 and 8 is achieved. Dip coating, curing and drying at 100° C. or greater provide the above blocking layer.

Photoconductive imaging members can then be prepared as illustrated herein.

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer thereover, a photogenerating layer and a charge transport layer, and wherein the hole blocking layer is comprised of a polymetallosiloxane.

2. A photoconductive imaging member in accordance with claim 1 wherein the polymetallosiloxane is of the formula

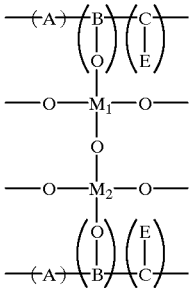

wherein A, B, and C each represent segments of the polymer; $M_1$ $M_2$ are a trivalent or tetravalent metal; and when $M_1$ or $M_2$ is a tetravalent metal, the bond structure in the sol-gel network is

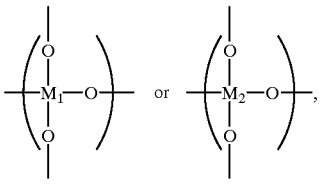

and when $M_1$ or $M_2$ is a trivalent metal the bond structure in the sol-gel network is

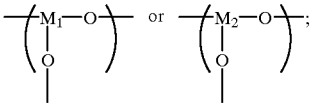

and E is an electron transport component.

3. A photoconductive imaging member in accordance with claim 1 wherein the polymetallosiloxane possesses a weight average molecular weight $M_w$ of from about 50,000 to about 100,000.

4. A photoconductive imaging member in accordance with claim 1 wherein the polymetallosiloxane possesses an $M_n$ of from about 2,000 to about 50,000.

5. A photoconductive imaging member in accordance with claim 1 wherein said metal for said polymetallosiloxane is titanium.

6. A photoconductive imaging member in accordance with claim 1 wherein said metal for said polymetallosi foxane is zirconium.

7. A photoconductive imaging member in accordance with claim 1 wherein said metal for said polymetallosiloxane is boron.

8. A photoconductive imaging member in accordance with claim 1 wherein said metal for said polymetallosiloxane is aluminum.

9. A photoconductive imaging member in accordance with claim 1 wherein said metal for said polymetallosiloxane is tin.

10. A photoconductive imaging member in accordance with claim 1 wherein said metal for said polymetallosiloxane is germanium.

11. A photoconductive imaging member in accordance with claim 1 wherein said metal for said polymetallosiloxane is lanthanum.

12. A photoconductive imaging member in accordance with claim 1 wherein the thickness of the hole blocking layer ranges from about 0.1 to about 3 microns.

13. A photoconductive imaging member in accordance with claim 1 wherein the supporting substrate is comprised of a metal.

14. A photoconductive imaging member in accordance with claim 1 wherein the substrate is aluminum.

15. A photoconductive imaging member in accordance with claim 1 wherein the photogenerator layer is of a thickness of from about 0.05 to about 5 microns.

16. A photoconductive imaging member in accordance with claim 1 wherein the transport layer is of a thickness of from about 10 to about 50 microns.

17. A photoconductive imaging member in accordance with claim 1 wherein the photogenerating layer is comprised of photogenerating pigments dispersed in a resinous binder, and which pigments are present in an amount of from about 5 percent by weight to about 95 percent by weight.

18. A photoconductive imaging member in accordance with claim 17 wherein the resinous binder is selected from the group consisting of polyesters, polyvinyl butyrals, polycarbonates, polystyrene-b-polyvinyl pyridine, and polyvinyl formals.

19. A photoconductive imaging member in accordance with claim 1 wherein the charge transport layer is comprised of an arylamine dispersed in a resinous binder.

20. A photoconductive imaging member in accordance with claim 19 wherein the arylamine is represented by the following formula

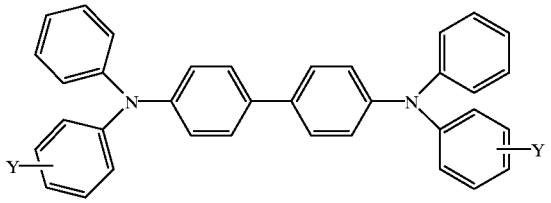

wherein Y is selected from the group consisting of alkyl and halogen.

21. A photoconductive imaging member in accordance with claim 20 wherein the alkyl contains from about 1 to about 25 carbon atoms.

22. A photoconductive imaging member in accordance with claim 20 wherein the alkyl contains from about 1 to about 5 carbon atoms.

23. A photoconductive imaging member in accordance with claim 20 wherein the arylamine is N,N'-diphenyl-N,N-bis(3-methyl phenyl)-1,1'-biphenyl-4,4'-diamine.

24. A photoconductive imaging member in accordance with claim 1 further including an adhesive layer.

25. A photoconductive imaging member in accordance with claim 1 wherein the photogenerating layer is comprised of metal phthalocyanines, perylenes or metal free phthalocyanines.

26. A photoconductive imaging member in accordance with claim 25 wherein titanyl phthalocyanine, perylene, or hydroxygallium phthalocyanine is selected as the photogenerating pigment.

27. A photoconductive imaging member in accordance with claim 1 wherein the photogenerating layer is comprised of Type V hydroxygallium phthalocyanine dispersed in a polymer binder.

28. A photoconductive imaging member in accordance with claim 1 and further containing a protective overcoat layer.

29. A method of imaging which comprises generating an electrostatic latent image on the imaging member of claim 1, developing the latent image, and transferring the developed electrostatic image to a suitable substrate.

* * * * *